US006428006B1

(12) United States Patent
Stewart

(10) Patent No.: US 6,428,006 B1
(45) Date of Patent: Aug. 6, 2002

(54) SIMULATED FOOTBALL BOARD GAME

(76) Inventor: Homer K. Stewart, P.O. Box 8006, Gulfport, MS (US) 39506

( * ) Notice: Subject to any disclaimer, the term of this patent is extended or adjusted under 35 U.S.C. 154(b) by 0 days.

(21) Appl. No.: 09/531,128

(22) Filed: Mar. 17, 2000

Related U.S. Application Data

(60) Provisional application No. 60/125,100, filed on Mar. 19, 1999.

(51) Int. Cl.[7] ..... A63F 3/00

(52) U.S. Cl. ..... 273/277; 273/259; 273/247

(58) Field of Search ..... 273/247, 259, 273/277, 236

(56) References Cited

U.S. PATENT DOCUMENTS

| | | | | |
|---|---|---|---|---|
| 516,789 | A | | 3/1894 | Hillis |
| 543,463 | A | | 7/1895 | Brown, Jr. |
| 1,190,003 | A | | 7/1916 | Quinn |
| 1,520,011 | A | | 12/1924 | Clark |
| 1,602,639 | A | | 10/1926 | Bosco |
| 1,603,717 | A | * | 10/1926 | Rubino |
| 1,613,530 | A | | 1/1927 | Peterson |
| 1,663,404 | A | | 1/1927 | Hands |
| 1,680,356 | A | | 8/1928 | Yaraus |
| 2,069,514 | A | | 2/1937 | Wylie |
| 3,386,738 | A | | 6/1968 | Wylie |
| 3,817,524 | A | | 6/1974 | Board |
| 4,082,278 | A | * | 4/1978 | Bolton |
| 4,443,011 | A | * | 4/1984 | Sheridan |
| 4,478,419 | A | | 10/1984 | Maiers |
| 4,815,745 | A | | 3/1989 | Alvarez, Jr. |
| 5,221,084 | A | | 6/1993 | Stelmach |
| 5,356,152 | A | | 10/1994 | Curry |
| 5,762,338 | A | * | 6/1998 | Hutchison |

FOREIGN PATENT DOCUMENTS

| | | | |
|---|---|---|---|
| GB | 2029707 | * | 9/1978 |

* cited by examiner

*Primary Examiner*—Benjamin H. Layno
*Assistant Examiner*—Vishu K. Mendiratta
(74) *Attorney, Agent, or Firm*—Diederiks & Whitelaw, PLC

(57) ABSTRACT

A simulated football board game includes a board resembling a miniature football field formed by a matrix of squares defining a playing field and opposing end zones, offensive player pieces, defensive player pieces and an element representing a football. The offense is provided with eleven players, while the defense is given an extra or twelve players due to attributes accorded the designated quarterback. Provisions are made to enable the offensive pieces to carry out blocking, running, passing, lateraling, hand-offs and punting. Defensively, there are tackles, interceptions and safeties. Touchdowns, as well as one and two point conversions, are also provided for.

19 Claims, 4 Drawing Sheets

KEY

0 =Offensive piece
X =Defensive piece
X/0 =Defensive block
0/X =Offensive block
% =Quarterback
Q =Ball

KEY

O =Offensive piece
X =Defensive piece
X/O =Defensive block
O/X =Offensive block
% =Quarterback
Q =Ball

KEY

O =Offensive piece
X =Defensive piece
X/O =Defensive block
O/X =Offensive block
% =Quarterback
ϕ =Ball

SIMULATED FOOTBALL BOARD GAME

This application claims benefit of provisional application No. 60/125,100, filed Mar. 19, 1999.

BACKGROUND OF THE INVENTION

1. Field of the Invention

The present invention pertains to the art of board games and, more particularly, to a board game which simulates the playing of a real football game.

2. Discussion of the Prior Art

Board games have long been a source of entertainment for many individuals. Given the popularity of football, it is not surprising that a fair number of board games have been proposed in the art to simulate the game of football. In general, these known games utilize pieces to represent football players and establish rules which enable offensive and defensive maneuvers to be performed in a manner analogous to a real football game.

Typically, these prior proposed games require the use of dice, spin boards and/or cards to further the action. Unfortunately, such peripheral equipment detract from the actual game simulation, mainly by placing a great deal of emphasis on chance, instead of promoting a more realistic approach to playing the game. For at least these reasons, there exists a need in the art for a board game which simulates, as closely as possible, the playing of a real football game.

SUMMARY OF THE INVENTION

The present invention pertains to a board game which simulates the playing of a real game of football through the use of a board which appears like a miniature football field but with a matrix of squares, arranged in a manner similar to a standard checker-type board, and end zones defined by multiple rows. A plurality of pieces are utilized to represent both offensive and defensive players in the game. In accordance with the most preferred embodiment of the invention, the offense has eleven players, while the defense is given an extra or twelve players due to the power accorded the quarterback. Provisions are made to enable the offensive pieces to carry out blocking, running, passing, punting and the like in a manner corresponding to a real football game. Touchdowns, one and two point conversions and safeties are also provided for. Defensively, there are tackles, interceptions and safeties.

Additional objects, features and advantages of the present invention will become more fully apparent from the following detailed description of the preferred embodiment when taken in conjunction with the drawings wherein like reference numbers refer to corresponding parts in the several views.

DETAILED DESCRIPTION OF THE PREFERRED EMBODIMENT

Figure 1:
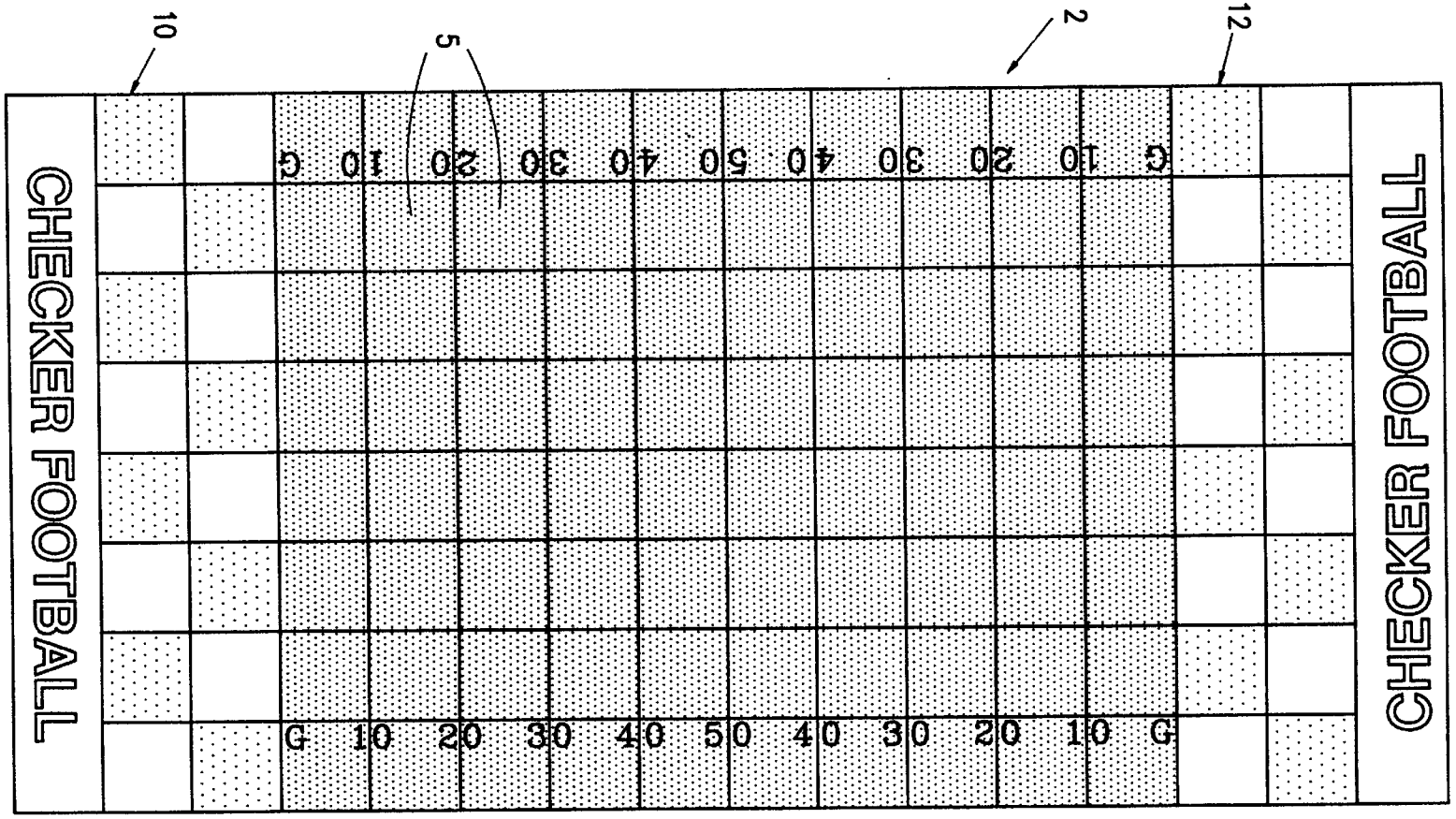
FIG. 1 is a plan view of a board constructed in accordance with the present invention.
Figure 2:
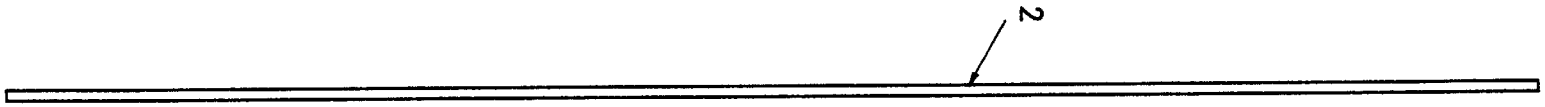
FIG. 2 is a side view of the board of FIG. 1.

With initial reference to FIG. 1, a game board, constructed in accordance with the present invention, is generally shown at 2 and basically represents a miniature football field. More specifically, board 2 constitutes a matrix of squares arranged in ten rows, with each row having eight squares 5. In addition, two end zones 10 and 12 are provided, with each end zone 10, 12 being preferably constituted by two rows. Between end zones 10 and 12, board 5 is preferably labeled with markers in increments of ten, similar to a standard football field. Prior to describing exemplary, permissible moves in accordance with the invention, the rules and regulations of the game will now be described.

OFFENSIVE RULES

1. The objective is to get the quarterback or ball carrier into the opponent's end zone for a touchdown.
2. The end zones are the two rows of squares, preferably of different colors, on each end of the board.
3. A touchdown is six (6) points; a safety is two (2) points. An extra point may be one (1) or two (2) points. A one point conversion is initiated by placing "the ball" on the offense's side of the fifty yard line. This is the only checker piece on the board. The piece is then thumped, i.e., flicked with a player's finger, once toward the opponent's goal line. If the checker lands on the goal line, then the offense gets one extra point. If it does not touch the line, then no points are given. To receive a two point conversion, both offensive and defensive teams are placed on the field. The offense is given one down to score from its fifty yard line. Preferably, there are no field goals in the game.
4. After a safety or touchdown, the next offensive series always starts on the team's 20 yard line. The exception to this rule is when a team takes the ball over after the second down or after a punt or an interception. In these cases, the offense starts where the ball was when the down was completed.
5. The offense has two (2) downs to score. If they do not score, the ball goes over to the defense after the second down.
6. The down is completed by either the tackling of the ball carrier, an incomplete pass, or when the ball carrier is trapped with no way of escaping or advancing.
7. A checker piece may be moved, forwards, backwards, sideways and, preferably diagonally, into any square that touches the square it is in as long as that square is not occupied. If the square is occupied by an opponent, then the player must enter into a "block" to control that particular square.
8. The quarterback may hand the ball to any of his men who are even with or behind a square next to his own. The ball may not be handed forward. A hand-off constitutes a move. Preferably, there are no fumbles in this game.
9. (Optional) You have thirty (30) seconds in which to make a move. There will be a twenty-five (25) second warning by the timer or opponent. At thirty (30) seconds, "time" will be called and if your checker piece is not in the proper place and your hand is off of the checker piece, you will forfeit the right to your move. This is the only penalty in the game.
10. (Optional) During your move, the first checker piece you touch is the one that must be moved.
11. In one preferred embodiment, the game is complete when a team has scored twenty (20) or more points and has at least two (2) touchdowns more than his opponent. On the other hand, both opponents could agree on a time limit and the one with the highest score when the time has expired will be declared the winner. If the game is tied when the time expires, then a flip of a coin will determine who gets the ball first on its side of the fifty yard line. Both teams will be given one down to score a touchdown and an additional down in which to score an extra point. If the game is still a tie, then the process will be repeated until a winner can be declared.

HOW TO BEGIN THE GAME

1. Preferably, the flip of a coin determines which team gets the ball first. The games opens with the offense taking the ball on its 20 yard line (the second row of squares out of the end zone).
2. The offense much have at least seven (7) men on the line of scrimmage. There are eleven (11) offensive players. The extra checker piece is placed on the quarterback to help identify him. Also, a single checker piece of a different color or another distinguishing piece will represent the ball and will be placed on the ball-carrier.
3. The offense always has the first move, but the defense must be allowed to be in position before the first move is made. The offense and the defense will take turns making moves until the down is completed.

OFFENSIVE FUNDAMENTALS

Blocking

1. The offense "blocks" by taking a single checker piece and placing that piece on top of an opponent's piece. The color of the checker piece on top signifies which team controls the block. It also may be used as a receiver or a ball carrier with certain restrictions.
2. Only a single checker piece may enter into a "block".
3. Once a checker piece enters into a "block" on offense or defense, it cannot come out of it. The checker piece can be moved, by the team with the top checker, a single square per turn and can also be further blocked by another single checker piece.

Advancing the Ball

1. The quarterback or ball carrier moves by going into an empty square one move at a time or by jumping any of his own men in any direction. Only the quarterback may jump his own men and he may jump as many times on a move as he desires.
2. Even though the quarterback has the ability to pass or hand the ball to any of his players, only a single player (one not involved in a "block") can inherit the ability of the quarterback to pass or jump his own men. Although he may be an eligible receiver or ball carrier, a player who is given the ball but is involved in a "block" cannot jump his own men or pass the football. Also, when the ball is received by a man in a "block", the ball must remain with him until the down is completed.

Passing

1. In order to pass the football, there must be a "passing lane" or an opening for the quarterback to throw through. A ball is passed by taking the top two checker pieces off of the quarterback and thumping the bottom checker piece to a receiver. It is a completion if the thumped checker piece hits the receiver before it hits an opponent. If the opponent is hit first, then the pass was intercepted and, at that point, it is the interceptor's move. A pass constitutes a move. Only one forward pass is allowed per down, but an unlimited amount of laterals is allowed, with each lateral constituting a move.
2. Once the quarterback crosses the line of scrimmage, he may not pass the football during that down.

Punting

1. On second down, the offense may choose to punt rather than use its second or last down. This must be stated before the down starts. When a team punts, the ball will be moved five (5) rows of squares. The receiving team actually lines up on the sixth square. If the ball is punted and the fifth square is in the opponent's end zone, then the ball will come out to the 20 yard line.

DEFENSIVE RULES

1. The defense always has the right to make any adjustment before the down starts.
2. The defense must open the game with at least six (6) men on the line of scrimmage. The defense starts with twelve (12) men. The offense starts with eleven (11) men. The defense is given the extra man because the quarterback is the most powerful player in the game.
3. For the defense to score a safety, the ball carrier must be tackled in the end zone.
4. After the defensive team scores a safety, the defensive unit then gets the ball for its offense.

DEFENSIVE FUNDAMENTALS

Blocking

1. In accordance with the invention, defensive "blocking" is permitted to create obstacles for the offensive team. Only a single checker piece may enter into a "block", thereby creating a stack of checkers two (2) or three (3) checkers high or even higher. Both the offense and the defense have an equal opportunity in controlling "blocks". The checker on top controls the "block".

Tackling

1. Only a single checker piece (one not involved in a "block") may make a "tackle" on a ball carrier. A "tackle" is made when a single checker piece has the move from a square next to the ball carrier. When the "tackler" is placed on top of the ball carrier, the down is complete.

Intercepting

1. If the quarterback is passing the football and the pass hits the defender before it hits the receiver, then the pass is intercepted and it is the interceptor's move.

Figure 3:
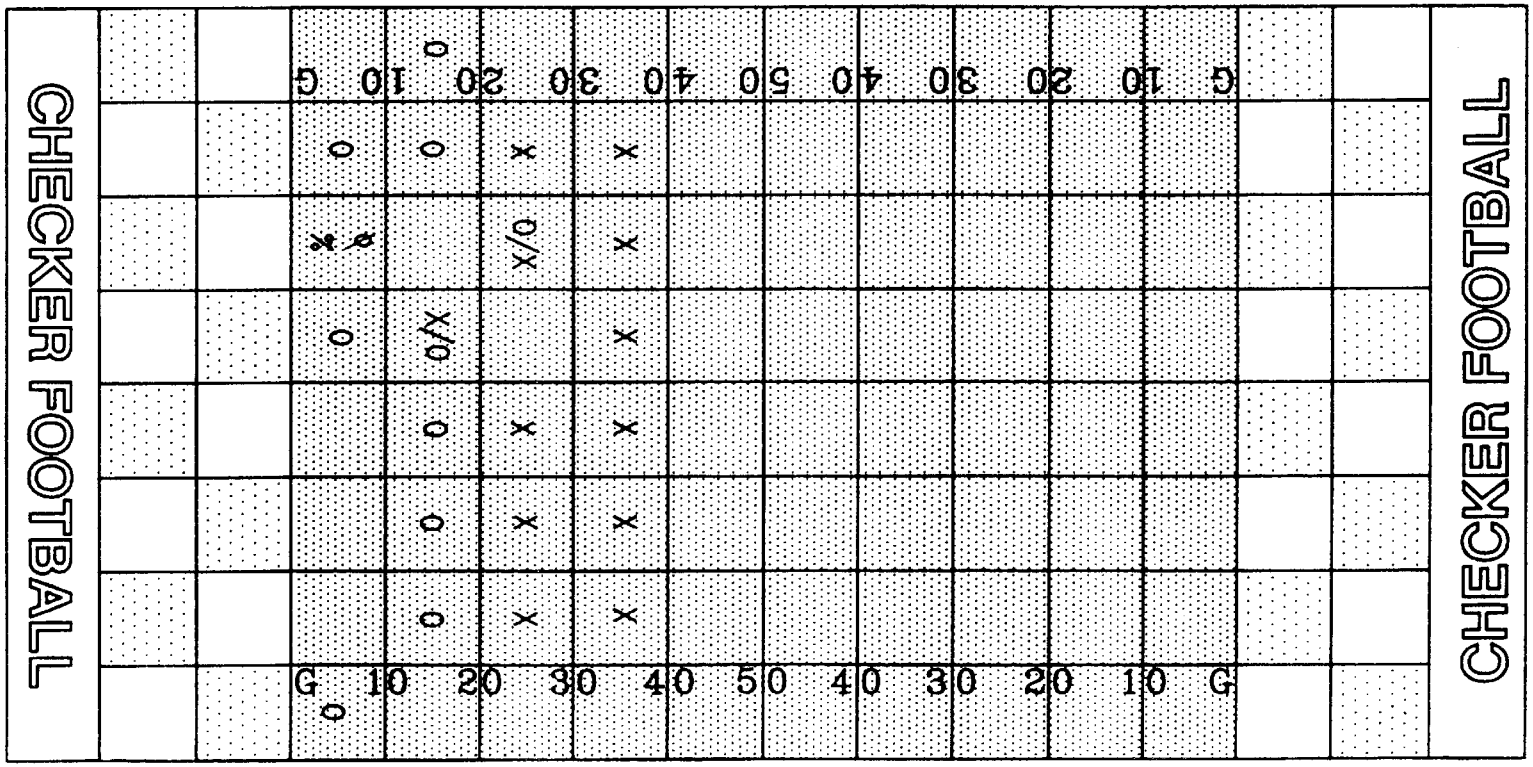
FIG. 3 shows the board of FIG. 1 illustrating the positions of various pieces following exemplary, opening offensive and defensive moves.
Figure 4:
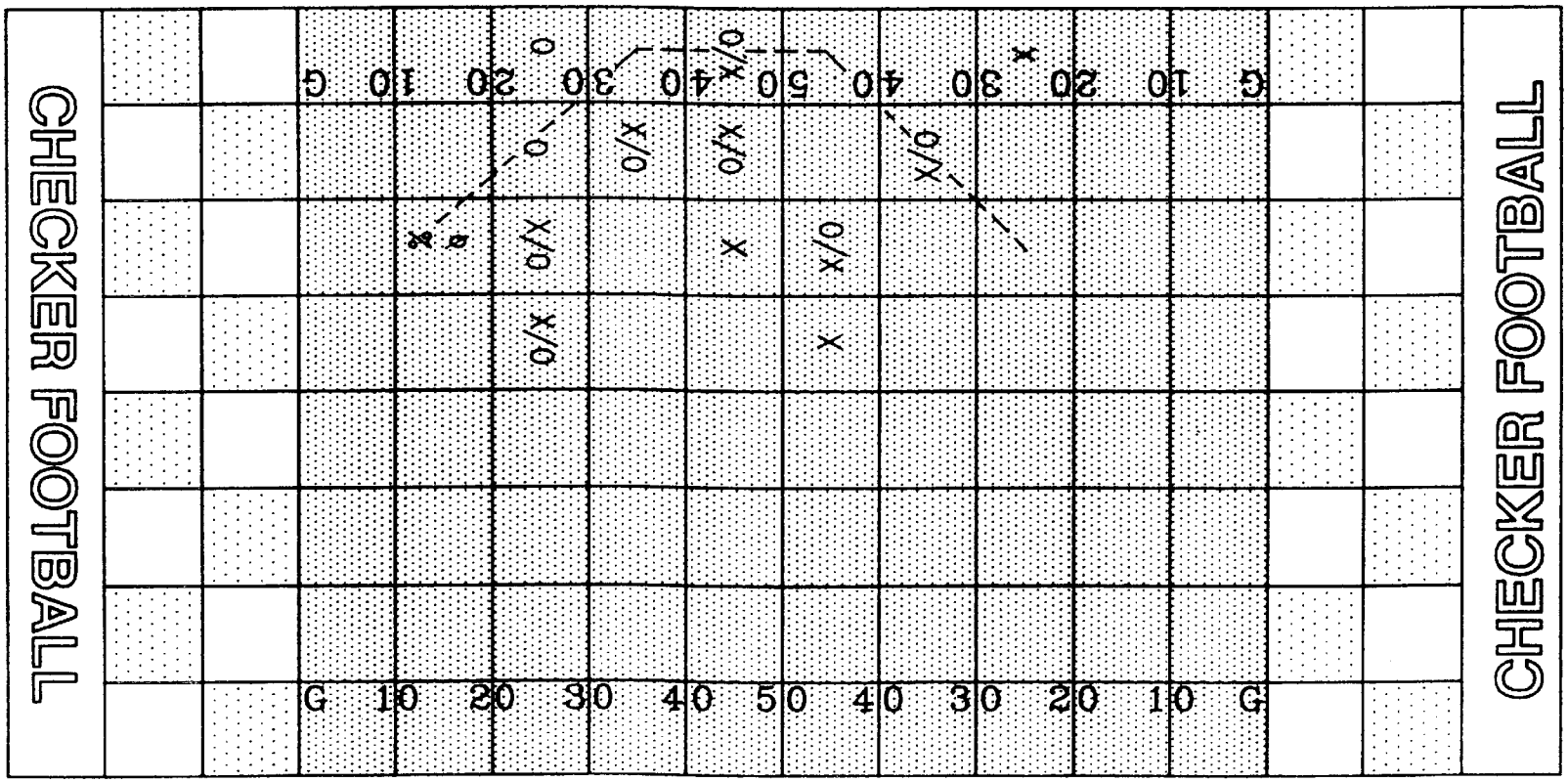
FIG. 4 shows the board of FIG. 1 illustrating the ability of the quarterback to jump other offensive men.
Figure 5:
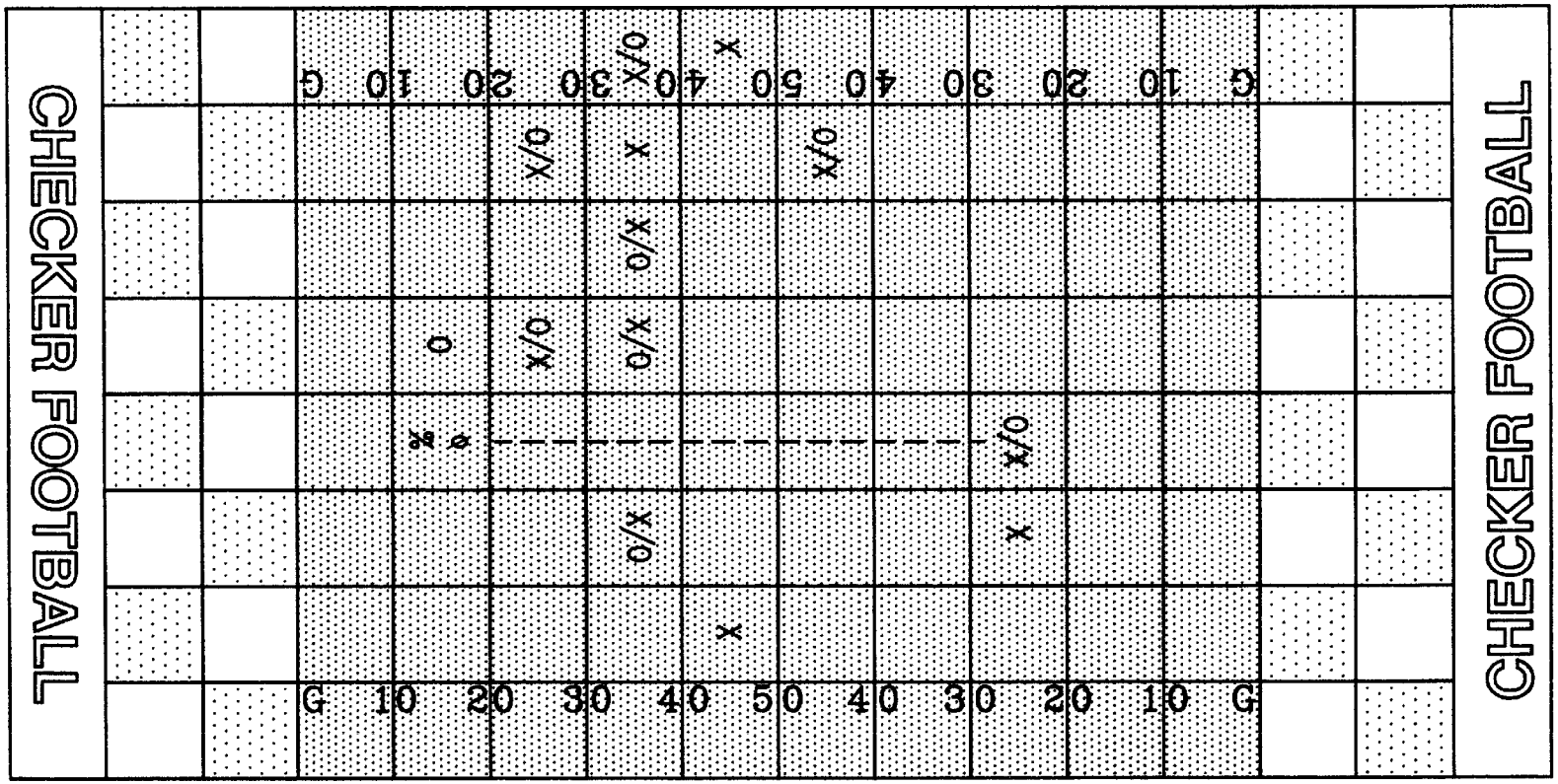
FIG. 5 illustrates an exemplary passing scenario available in the game.

FIG. 3 illustrates an exemplary opening sequence, wherein the offensive center has blocked the defensive nose guard and the defensive left guard has taken control of the offensive right guard. FIG. 4 shows another possible move wherein the quarterback is illustrated as jumping his own men. Finally, FIG. 5 illustrates a passing arrangement wherein a passing lane is first created. Thereafter, the top two pieces are removed from on the quarterback piece. The bottom piece is then thumped toward the receiver in the passing lane, i.e., the piece is flicked with the player's finger to slide through the passing lane. As indicted above, if the sliding piece hits the receiver piece before another piece, then the pass is completed. If the sliding piece initially hits a defender, then there is an interception. If the sliding piece completely misses other pieces, the pass is incomplete and a loss of down occurs. As also indicated above, the offense is preferably only provided with two downs. If the offense advances the ball piece to the mid or fifty (50) yard line at the end of the second down, then the opponent will take over as the offense in the adjacent row of squares which they occupy.

From the above description, it should be recognized that there exists an abundance of possible game scenarios depending on the exact strategy and tactics taken by each of the players. It should also be apparent that the game is designed to allow young individuals to compete with older individuals, once key game concepts are realized. As in a real game of football, concepts such as containment and penetration are very important. Simply stated, the game enables players to line up and match skills in a high level game of strategy requiring constant adjustments. Although the invention has been described with respect to a preferred embodiment, it should be understood that various changes and/or modifications could be made without departing from the invention. For instance, it would be possible to allow a player piece in a block to tackle the carrier of the football or to enter into another block by being placed upon another or additional opponent piece; to provide for field goals, such as in a manner similar to extra points but from the current line of scrimmage; or to limit diagonal movement to certain players, such as the quarterback. In any event, the invention is only intended to be limited by the scope of the following claims.

I claim:

1. A method of playing a simulated football game on a board resembling a miniature football field made up of a matrix of squares with a plurality of offensive player pieces, a plurality of defensive player pieces, and an element representing a football comprising the steps of:

1) setting the board for play by:

a) arranging the plurality of offensive player pieces, within respective squares of the matrix of squares, along and behind a line of scrimmage while designating one of the offensive player pieces as a quarterback piece;

b) arranging the plurality of defensive player pieces, within respective squares of the matrix of squares, along and behind an opposing side of the line of scrimmage; and c) initially designating the quarterback piece as a carrier of the football;

2) playing a set down by:

a) repositioning one offensive piece of the plurality of offensive player pieces into an adjacent square on the board with the one offensive piece, if not the carrier of the football, being permitted to enter an unoccupied square on the board or into a block wherein the one offensive player piece is positioned atop one of the defensive player pieces in an adjacent square and, if the carrier of the football and not in a block, to enter an unoccupied square, to jump another adjacent offensive player piece into an unoccupied square, to hand the football to an adjacent offensive player thereby redesignating the carrier of the football, to lateral the football to an offensive player aligned with the carrier of the football or to pass the football to an offensive player aligned with the carrier of the football;

b) repositioning one defensive piece of the plurality of defensive player pieces into an adjacent square on the board with the one defensive piece being permitted to enter an unoccupied square on the board, enter into a block wherein the one defensive player piece is positioned atop one of the offensive player pieces in an adjacent square, intercept a pass or lateral to reverse the offensive and defensive player designations, or tackle the offensive piece designated as the carrier of the football if the carrier of the football occupies an adjacent square;

c) repeating sub-steps a) and b) under step 2) until either the carrier of the football scores a touchdown by reaching a defensive end zone, is tackled, or an incomplete pass or lateral is made; and d) switching offensive and defensive player designations after a predetermined number of set downs; and 3) repeating steps 1) and 2) until playing of the simulated football game is terminated.

2. The method according to claim 1, wherein the arranging of the plurality of offensive player pieces in step 1), sub-step a) requires placing at least seven of the offensive player pieces along the line of scrimmage.

3. The method according to claim 2, wherein the arranging of the plurality of defensive player pieces in step 1), sub-step b) requires placing at least six of the defensive player pieces on the line of scrimmage.

4. The method according to claim 3, wherein the offensive and defensive player pieces are positioned along the line of scrimmage defined by a row of eight laterally adjacent squares.

5. The method according to claim 2, wherein the arranging of the plurality of offensive player pieces requires placing a total of eleven offensive player pieces directly on the board.

6. The method according to claim 5, wherein the arranging of the plurality of defensive player pieces in step 1), sub-step b) requires placing at least six of the defensive player pieces on the line of scrimmage.

7. The method according to claim 6, wherein the arranging of the plurality of defensive player pieces requires placing a total of twelve defensive player pieces on the board.

8. The method according to claim 1, wherein the arranging of the offensive and defensive player pieces in step 1) sub-steps a) and b) requires positioning a total of eleven offensive player pieces and twelve defensive player pieces directly on the board.

9. The method according to claim 1, further comprising: designating the quarterback piece by stacking two offensive player pieces one on another.

10. The method according to claim 1, wherein the predetermined number of set downs equals two.

11. The method according to claim 1, further comprising: completing a lateral or pass of the football in step 2) by flicking one of the pieces to cause the flicked piece to slide from a square occupied by the carrier of the football towards another, receiving offensive player piece and hitting the receiving offensive player piece with the flicked piece.

12. The method according to claim 11, further comprising: intercepting a lateral or pass by having the flicked piece hit a defensive player piece before the flicked piece comes to rest.

13. The method according claim 1, further comprising: permitting an offensive player piece, which is the carrier of the football and not the designated quarterback, to inherit abilities of the designated quarterback to pass to and jump other offensive player pieces.

14. The method according to claim 13, further comprising: preventing the offensive player piece from inheriting the abilities to pass to or jump other offensive player pieces if the offensive player piece has been involved in a block with a defensive player piece.

15. The method according to claim 1, further comprising: enabling only offensive and defensive player pieces, which have not already entered into a block, to enter into a subsequent block by being positioned atop an opposing player piece.

16. The method according to claim 1, further comprising:

punting, prior to reaching the predetermined number of set downs, by moving the element representing the football a predetermined distance towards the defensive end zone; and establishing a new line of scrimmage based on the predetermined distance if the football element does not reach the end zone, or at least one row away from the end zone if the football element enters the end zone.

17. The method according to claim 1, further comprising:

scoring an extra point after a touchdown by placing an offensive player piece along a designating scrimmage line and flicking the offensive player piece to slide towards the end zone, with the extra point being scored if the offensive player piece comes to rest on a goal line of the end zone.

18. The method of claim 1, further comprising:

scoring a two point conversion after a touchdown by following step 1) and step 2), sub-steps a)–c) for a single down, starting at a designated scrimmage line, with the two point conversion being achieved if the end zone is reached by the carrier of the ball before the carrier of the ball is tackled.

19. A simulated football board game consisting of:

a board resembling a miniature football field formed by a matrix of squares defining a playing field eight rows wide and ten rows long, as well as opposing end zones each being eight rows wide and two rows long;

eleven offensive player pieces, one of which is designated a quarterback piece;

twelve defensive player pieces; and an element representing a football.

* * * * *